US007982150B2

(12) United States Patent
Yu

(10) Patent No.: US 7,982,150 B2
(45) Date of Patent: Jul. 19, 2011

(54) SWITCH ASSEMBLY HAVING INDICATOR

(76) Inventor: Tsung Mou Yu, Taipei (TW)

( * ) Notice: Subject to any disclaimer, the term of this patent is extended or adjusted under 35 U.S.C. 154(b) by 339 days.

(21) Appl. No.: 12/420,058

(22) Filed: Apr. 8, 2009

(65) Prior Publication Data

US 2010/0258418 A1 Oct. 14, 2010

(51) Int. Cl.
*H01H 9/00* (2006.01)

(52) U.S. Cl. ..... 200/315

(58) Field of Classification Search ..... 200/276, 200/61.08, 553–563, 302.3, 303, 308, 310, 200/313–317, 339; 439/490
See application file for complete search history.

(56) References Cited

U.S. PATENT DOCUMENTS

| | | | | |
|---|---|---|---|---|
| 3,609,268 | A * | 9/1971 | Sanchez | 200/315 |
| 4,347,417 | A * | 8/1982 | Sorenson | 200/433 |
| 5,105,059 | A * | 4/1992 | Sorenson et al. | 200/302.3 |
| 5,451,733 | A * | 9/1995 | Olson et al. | 200/315 |
| 5,496,981 | A * | 3/1996 | Sorenson | 200/315 |
| 6,103,982 | A * | 8/2000 | Chien | 200/315 |
| 6,590,175 | B1 * | 7/2003 | Lam | 200/315 |

* cited by examiner

*Primary Examiner* — Edwin A. Leon

(57) ABSTRACT

A switch assembly having an indicator includes a case, a switch member, at least two terminals, a conductive member and an indicator. The case includes a cover and the switch member is pivotally connected to the case. The terminals are electrically connected to a circuit and the conductive member actuated by the switch member to control the circuit to be an open circuit or a closed circuit. The indicator is installed within the switch member and has two legs which are connected to the cover of the case. Two resilient members are respectively biased between the two legs and the two terminals, thereby ensuring electrically connecting the legs with the terminals.

6 Claims, 8 Drawing Sheets

SWITCH ASSEMBLY HAVING INDICATOR

BACKGROUND OF THE INVENTION

1. Field of the Invention

The present invention relates to a switch assembly having an indicator, and more particularly to a switch assembly having an indicator that includes two resilient members respectively biased between legs of the indicator and terminals of the switch assembly to ensure the electrical connection therebetween.

2. The Prior Arts

There are various switch assemblies available in the market. Usually, the switch assembly includes a push-type switch member or toggle-type switch member to control a circuit to perform "ON" and "OFF" functions.

One type of conventional switch assemblies includes an indicator received therein. The indicator shows the state of the switch assembly to the users, so that the users can easily know the switch assembly is switched on or off. Further, the indicator emits light in the dark, so the user can know where the switch assembly is and the state of the switch assembly.

However, the switch assembly with indicator has some disadvantages. First of all, if the legs of the indicator are not securely connected to the circuit of the switch assembly, the indicator keeps flashing. Secondly, the legs of the indicator are usually connected to the circuit of the switch assembly by spot welding, hooking up or embedding. The connection at connection point gets loose due to rusting, corrosion or mechanical loosing after being used for a period of time. Once the connection between the legs and the circuit fails, the indicator cannot work. Thirdly, spot welding is the most common way to connect the legs of the indicator with the circuit. However, the size of the switch assembly is small and the space for spot welding is limited, which make the spot welding inconvenient and results in high manufacturing cost.

Therefore, installing the indicator in the conventional switch assembly is not satisfying and needs to be improved.

SUMMARY OF THE INVENTION

A primary objective of the present invention is to provide a switch assembly having an indicator, which overcomes the aforementioned disadvantages of the conventional design.

The solution of the present invention is to provide a switch assembly having an indicator that includes a case, a switch member, at least two terminals, a conductive member and an indicator. The case includes a cover and the switch member is connected to the case. The terminals are electrically connected to a circuit of the switch assembly and the conductive member controls the circuit of the switch assembly to be "ON" or "OFF". The indicator is installed within the switch member and has two legs. The indicator and the two legs are connected to the cover of the case. Two resilient members are respectively biased between the two legs and the two corresponding terminals. The biased resilient members provide forces to ensure the connection between the legs and the terminals. When the circuit is in an "ON" state, the indicator lights up and when the circuit is in an "OFF" state, the indicator does not light up.

One of the advantages of the switch assembly having an indicator according to the present invention is providing the resilient members to contact and electrically connect the legs of the indicator with the terminals. The biased resilient members provide elastic force to make sure components in the switch assembly is securely connected. Therefore the switch assembly having an indicator according to the present invention overcomes the disadvantages of conventional designs, such as poor connection between the legs of the indicator and the circuit.

Another advantage of the switch assembly having an indicator according to the present invention is using elasticity of the resilient members to contact and electrically connect the legs of the indicator with the terminals. Therefore it is easy and quick to assemble the switch assembly having an indicator according to the present invention, and the manufacture cost is reduced. The present invention overcomes the drawbacks of the assembling methods, such as spot welding, hooking up or embedding, used by the conventional switch assembly. The drawbacks includes the connection get loose due to oxidizing, rusting or corrosion after being used for a period of time, and the narrow space to proceed the spot welding. The present invention also solves the drawbacks of high manufacturing cost and long time of assembly.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
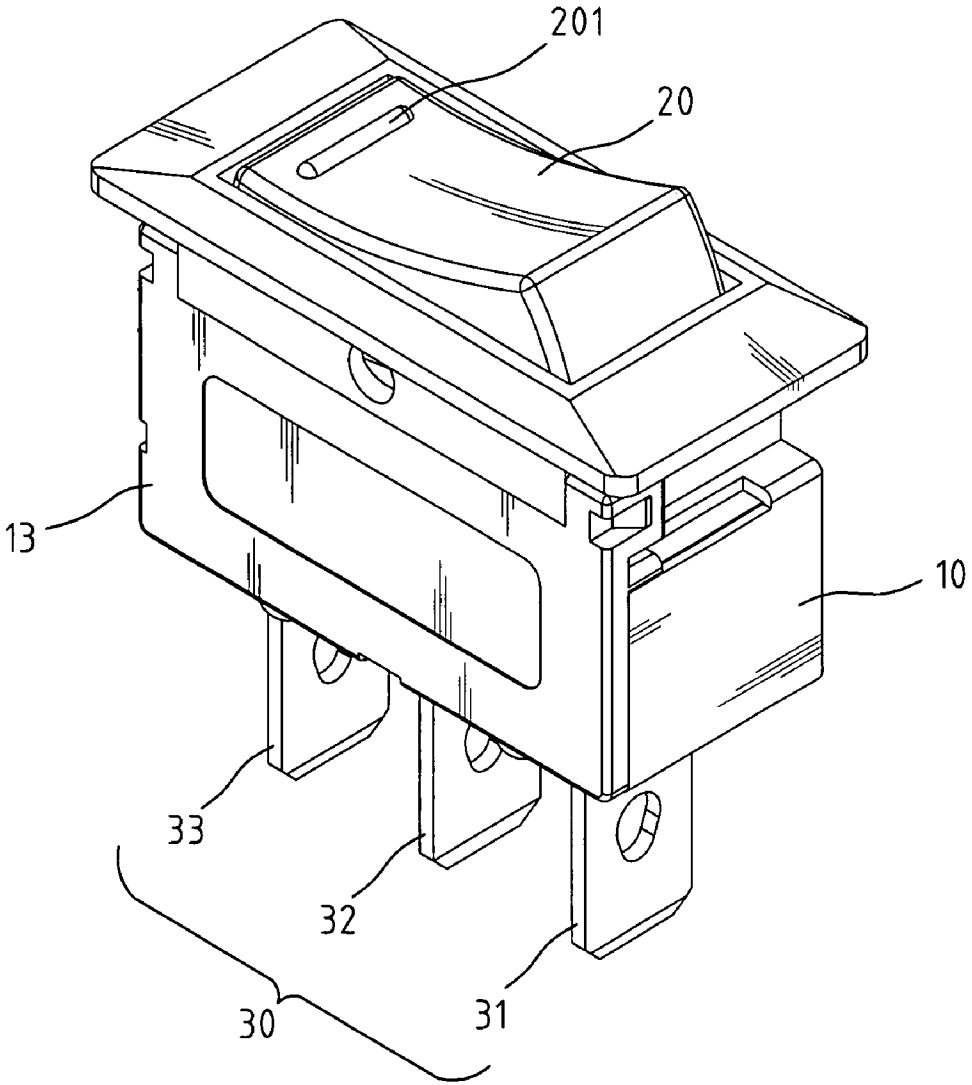
FIG. 1 is a perspective view showing a switch assembly having an indicator in accordance with a first embodiment of the present invention.
Figure 2:
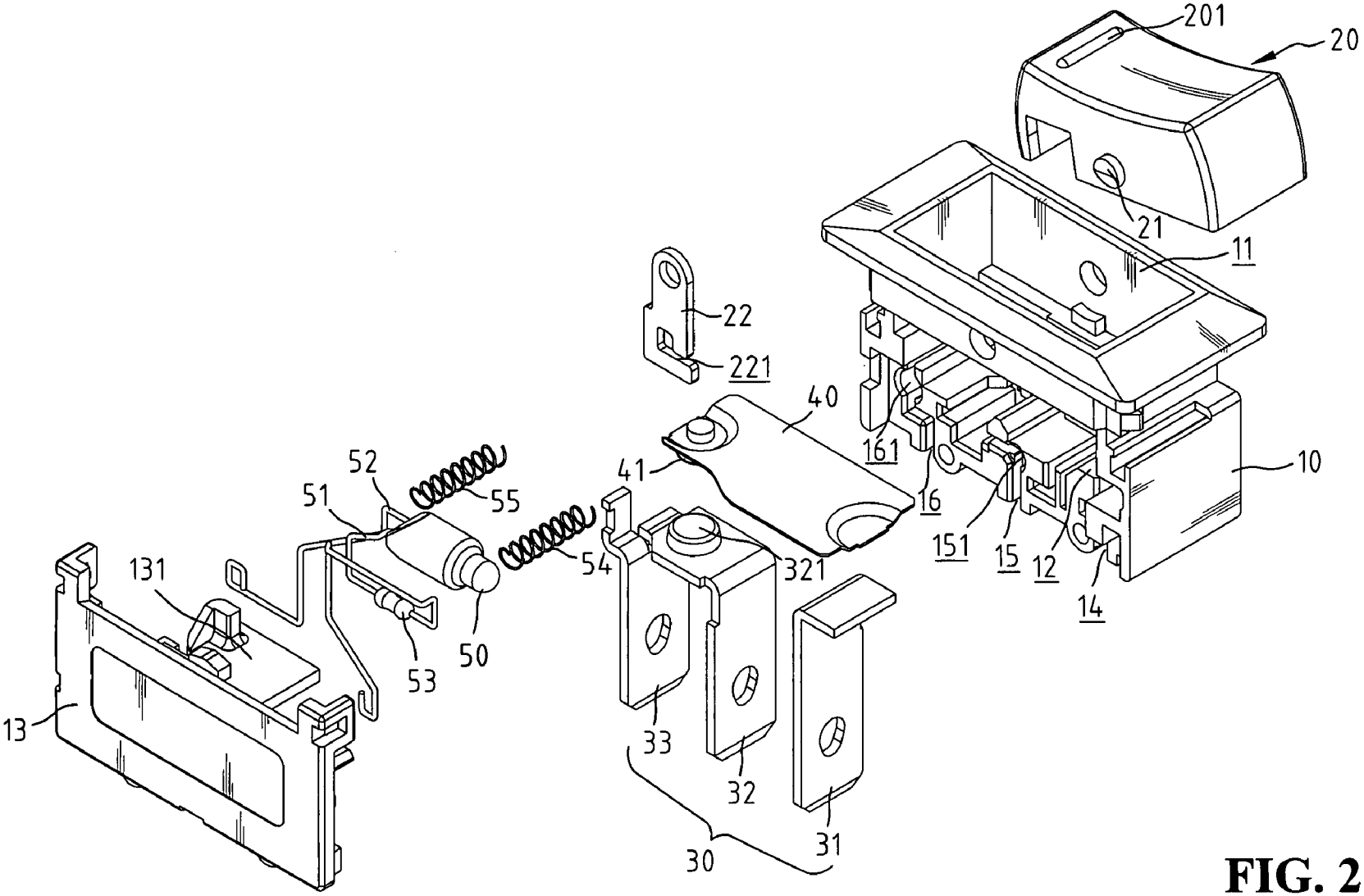
FIG. 2 is an exploded view showing the switch assembly according to the present invention.

With reference to the drawings and in particular to FIGS. 1 to 4, a switch assembly having an indicator in accordance with a first embodiment of the present invention comprises a hollow case 10, a switch member 20, at least two terminals 30, a conductive member 40 and an indicator 50.

A top opening 11 is defined in top of the case 10 and the switch member 20 is engaged into the top opening 11. An assembling opening 12 is defined at a side of the case 10 so that components for the switch assembly can be installed into the case 10. A cover 13 assembles with the case 10 to cover the assembling opening 12. The indicator 50 is installed at an inner side of the cover 13. In the first embodiment, a board 131 extends from the inner side of the cover 13. The cover 13 includes a first clamp member 132 and a second clamp member 133. Each of the first clamp member 132 and the second clamp member 133 has a clamp slot. The case 10 includes a plurality of slots corresponding to the terminals 30. The case 10 according to the first embodiment has a first slot 14, a second slot 15 and a third slot 16, wherein a top of the second slot 15 includes a first recess 151 and a top of the third slot 16 includes a second recess 161.

The switch member 20 is a hollow member and controls the conductive member 40. Two pivots 21 are disposed at both sides of the switch member 20 and pivotally connected with two pivot openings disposed at both sides of the case 10, respectively. The switch member 20 is pivotally connected to a connection plate 22 which includes an engaging notch 221 at a lower portion thereof A free end of the conductive member 40 is engaged with the engaging notch 221 of the connection plate 22. The switch member 20 has a transparent strip 201 that is made of a transparent material or a translucent material. Of course, the switch member 20 can be made of a transparent material or a translucent material.

The terminals 30 are used to be connected to a circuit and are respectively assembled with the case 10. The terminals 30 according to the first embodiment include a first terminal 31, a second terminal 32 and a third terminal 33. The first terminal 31 is received in the first slot 14 and a distal end (lower end) of the first terminal 31 extends out of the case 10. The second terminal 32 is received in the second slot 15. A second contact point 321 is formed at an upper end of the second terminal 32 and a distal end (lower end) of the second terminal 32 extends out of the case 10. The third terminal 33 is received in the third slot 16 and a distal end (lower end) of the third terminal 33 extends out of the case 10.

The conductive member 40 controls the circuit of the switch assembly to be "ON" or "OFF". The conductive member 40 according to the first embodiment is a flexible metal plate which bends towards different directions when being heated. One end of the conductive member 40 is fixed to and electrically connected with an upper end of the first terminal 31, and the other end of the conductive member 40 is a free end. The free end of the conductive member 40 includes a first contact point 41 corresponding to the second contact point 321 of the second terminal 32. The free end of the conductive member 40 is engaged with the engaging notch 221 of the connection plate 22. Therefore, when switching the switch member 20, the connection plate 22 moves up and down. Then, the free end of the conductive member 40 follows the connection plate 22 of the switch member 20 to move up and down. The first contact point 41 is contacted with the second contact point 321 when the free end of the conductive member 40 moves down.

The indicator 50 is installed within the switch member 20 and includes a first leg 51 and a second leg 52, wherein the first leg 51 is connected with a resistor 53. The first leg 51 and the second leg 52 are connected to the inner side of the cover 13. An end of the first leg 51 and an end of the second leg 52 are electrically connected with a first resilient member 54 and a second resilient member 55, respectively. According to the first embodiment, the first resilient member 54 and the second resilient member 55 are helical springs.

When assembling the switch assembly, the indicator 50 is mounted on the board 13 1. The first leg 51 of the indicator 50 is connected to the inner side of the cover 13, and clamped in the clamp slot of the first clamp member 132. The second leg 52 of the indicator 50 is connected to the inner side of the cover 13, and clamped in the clamp slot of the second clamp member 133. One end of the first resilient member 54 is inserted into the first recess 151 of the second slot 15, and the other end of the first resilient member 54 sleeves on the first clamp member 132. One end of the second resilient member 55 is inserted into the second recess 161 of the third slot 16, and the other end of the second resilient member 55 sleeves on the second clamp member 133. After that, the cover 13 is mounted to the assembling opening 12, wherein the indicator 50 is located in a lower portion of the switch member 20. The cover 13 compresses the first resilient members 54 and the second resilient members 55 against the second terminal 32 and the third terminal 33, respectively. Therefore, the two ends of the first resilient member 54 are electrically connected to the first leg 51 and the second terminal 32, respectively. The two ends of the second resilient member 55 are electrically connected to the second leg 52 and the third terminal 33, respectively. The weak-current circuit of the indicator 50 includes the second terminal 32, the first resilient member 54, the first leg 51, the resistor 53, the first leg 51, the indicator 50, the second leg 52, the second resilient member 55 and the third terminal 33.

Figure 3:
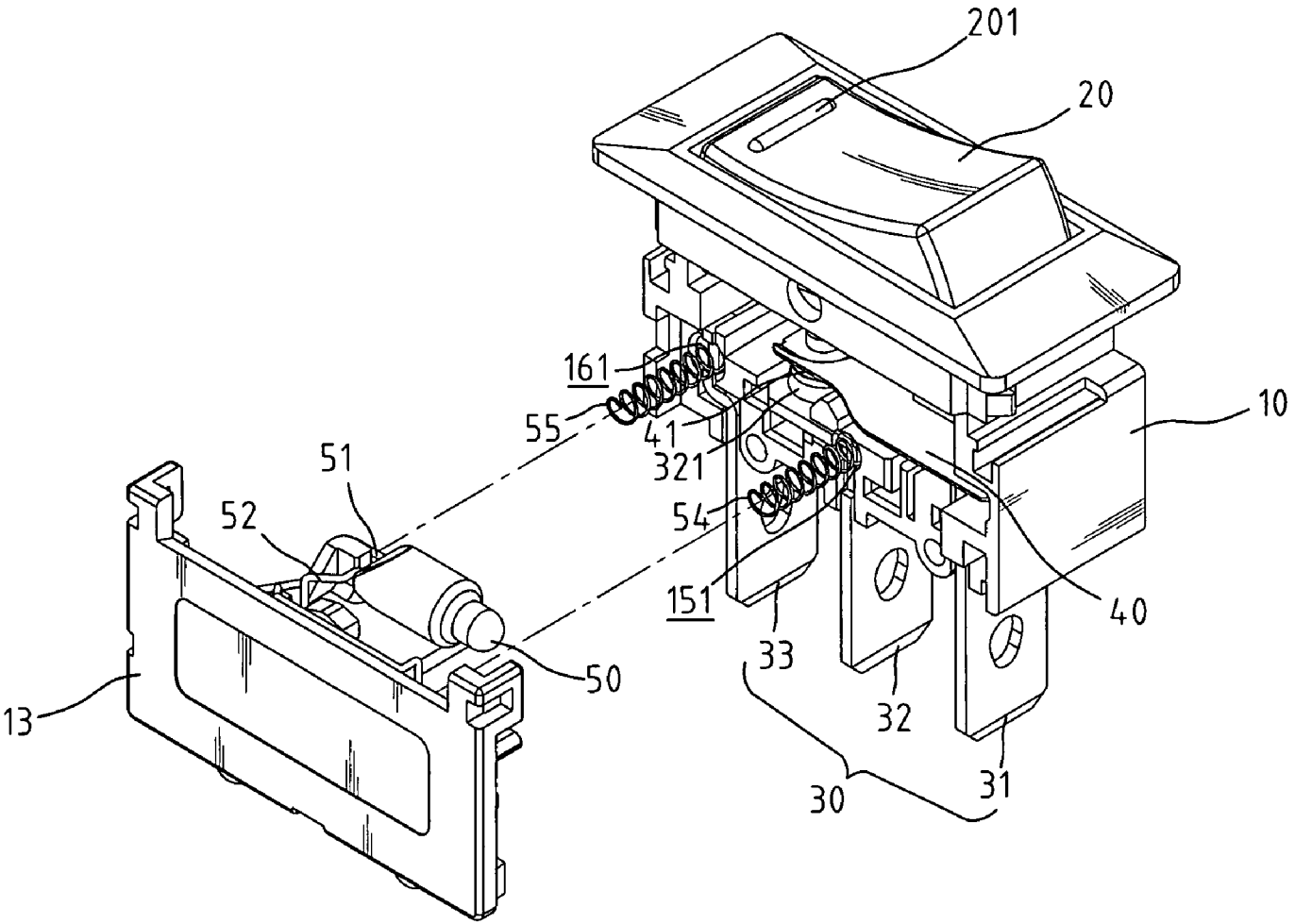
FIG. 3 is a partial exploded view showing the switch assembly according to the present invention.
Figure 4:
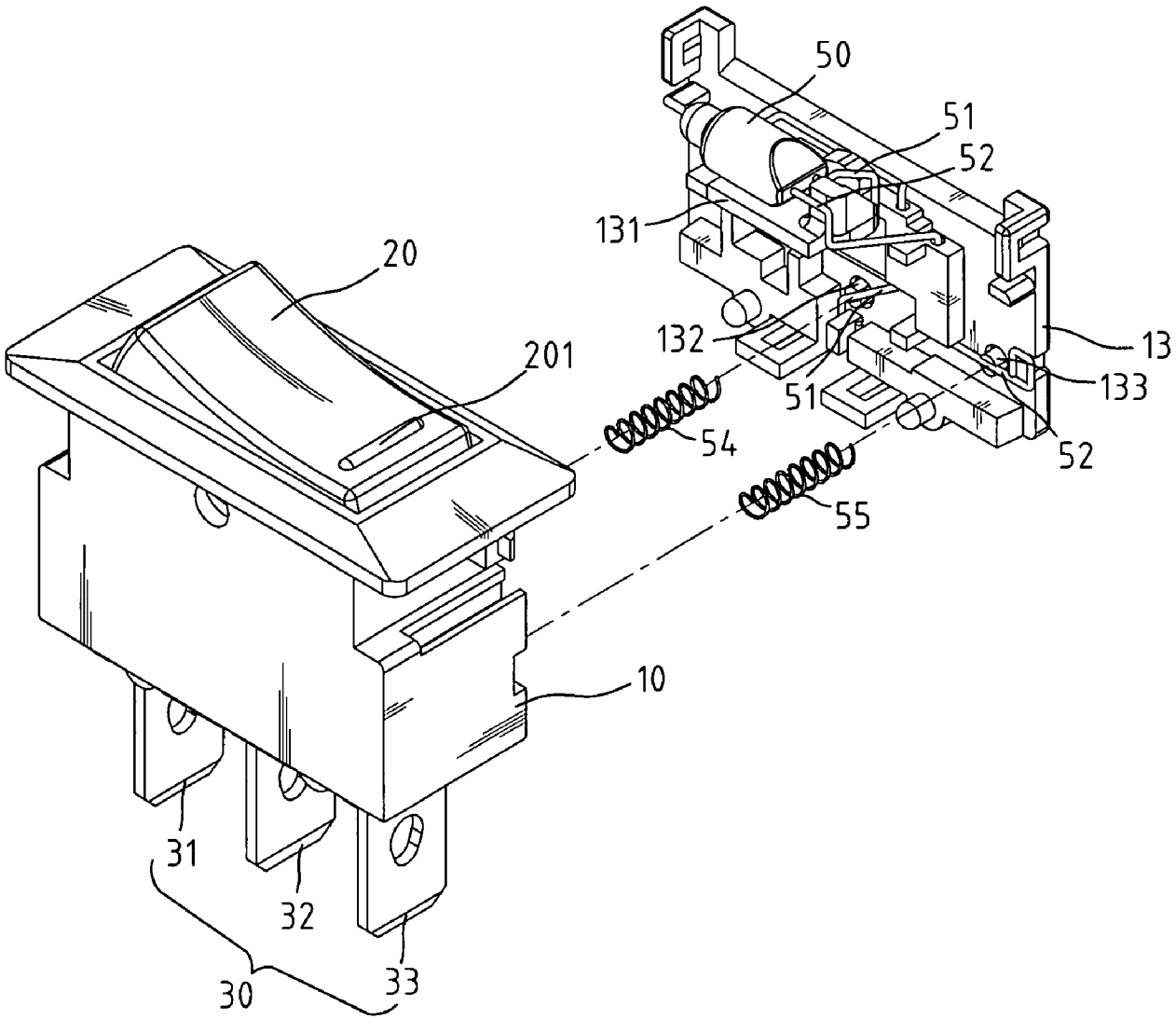
FIG. 4 is yet another partial exploded view showing the switch assembly according to the present invention.
Figure 5:
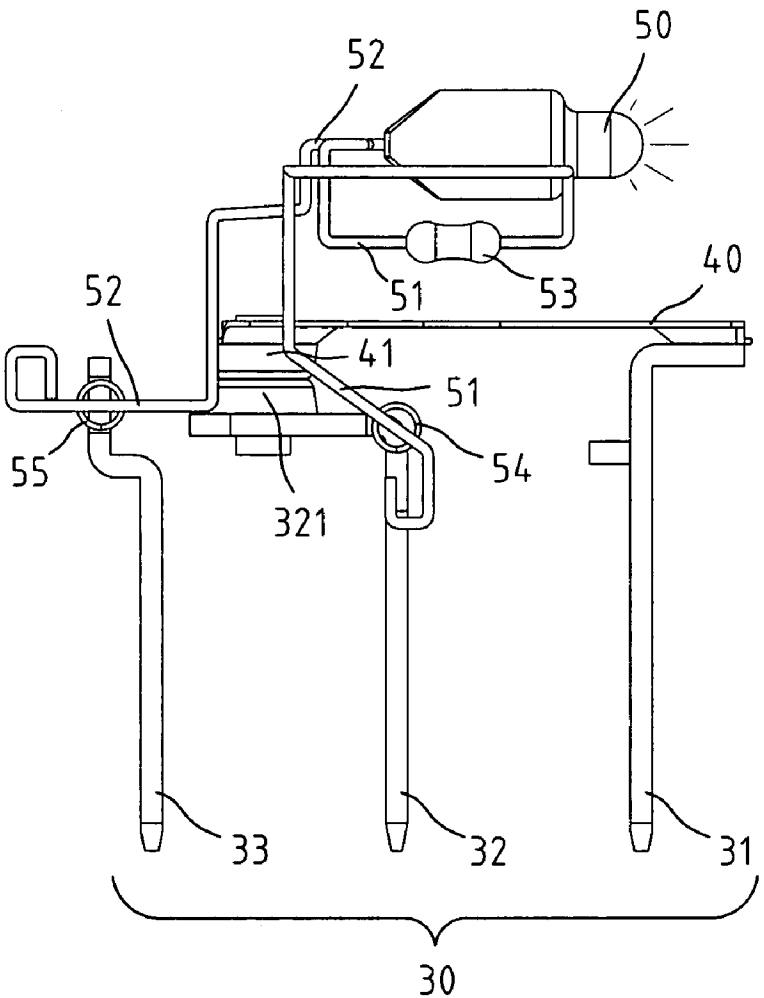
FIG. 5 is a schematic view showing the switch assembly according the present invention is in an "ON" state.

FIG. 5 shows the switch assembly is in an "ON" state. Referring to FIGS. 3 and 5, the left end of the switch member 20 is pressed down, and thus the connection plate 22 is pushed downward. The free end of the conductive member 40 held by the engaging notch 221 of the connection plate 22 is moved downward, which makes the first contact point 41 contact with the second contact point 321. The circuit of the switch assembly becomes an "ON" state and the current flows through the first terminal 31, the conductive member 40, the first contact point 41, the second contact point 321 and the second terminal 32. The weak-current circuit of the indicator 50 is formed, and the current flows through the first terminal 31, the conductive member 40, the first contact point 41, the second contact point 321, the second terminal 32, the first resilient member 54, the first leg 51, the resistor 53, the first leg 51, the indicator 50, the second leg 52, the second resilient member 55 and the third terminal 33. Because the weak-current circuit becomes a closed circuit, the indicator 50 lights up.

The light emitted from the indicator 50 can be seen through the transparent strip 201 of the switch member 20. If the switch member 20 is made of a transparent material or a translucent material, the light emitted from the indicator 50 can be seen through the switch member 20.

Figure 6:
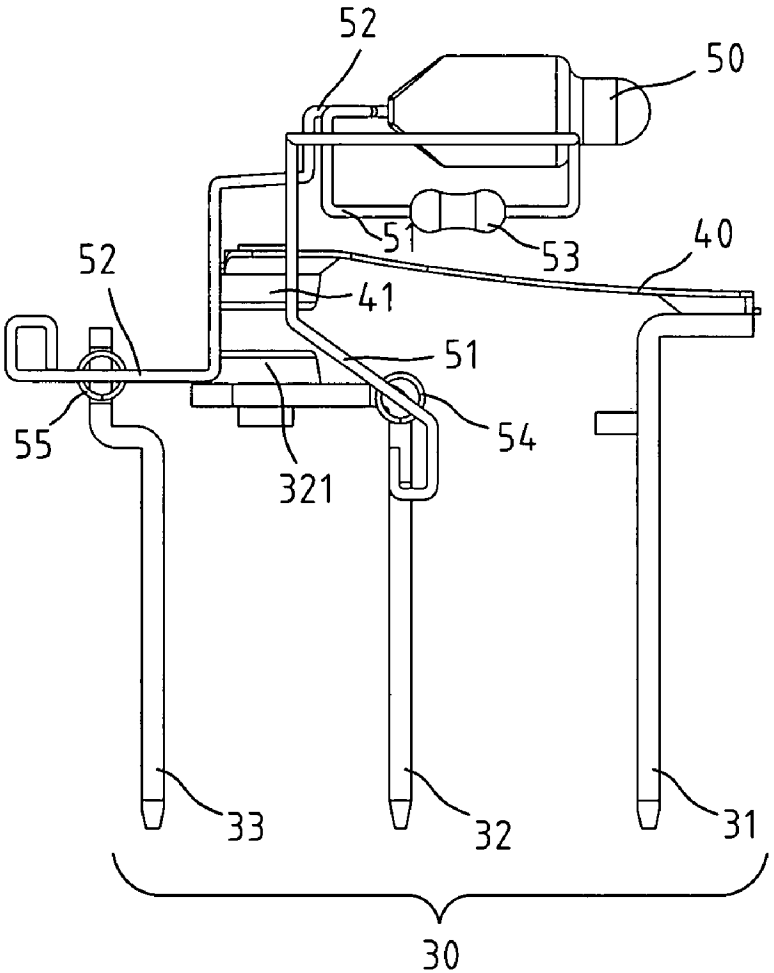
FIG. 6 is a schematic view showing the switch assembly according the present invention is in an "OFF" state.

As shown in FIG. 6, the switch assembly is in an "OFF" state. The right end of the switch member 20 is pressed down, and thus the connection plate 22 is pulled upward. The free end of the conductive member 40 held by the engaging notch 221 of the connection plate 22 is moved upward, which makes the first contact point 41 separate from the second contact point 321. The circuit of the switch assembly, which is formed by the first terminal 31, the conductive member 40, the first contact point 41, the second contact point 321 and the second terminal 32, is separated between the first contact point 41 and the second contact point 321. Therefore, the circuit of the switch assembly is in an "OFF" state. Similarly, the weak-current circuit of the indicator 50 is separated between the first contact point 41 and the second contact point 321. Because the weak-current circuit becomes an open circuit, the light of the indicator 50 is put off.

Figure 7:
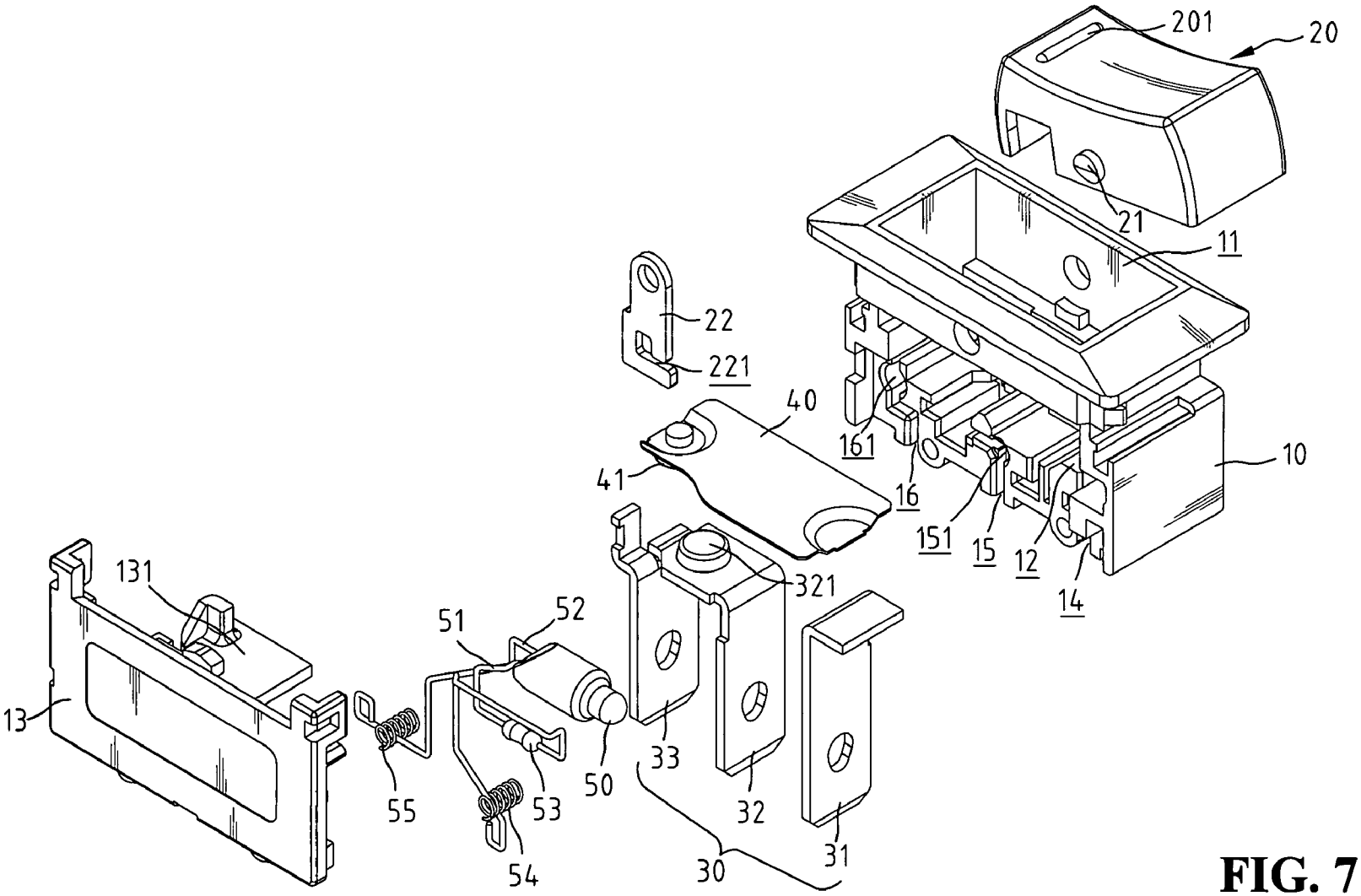
FIG. 7 is a partial exploded view showing a switch assembly having an indicator according to a second embodiment of the present invention.
Figure 8:
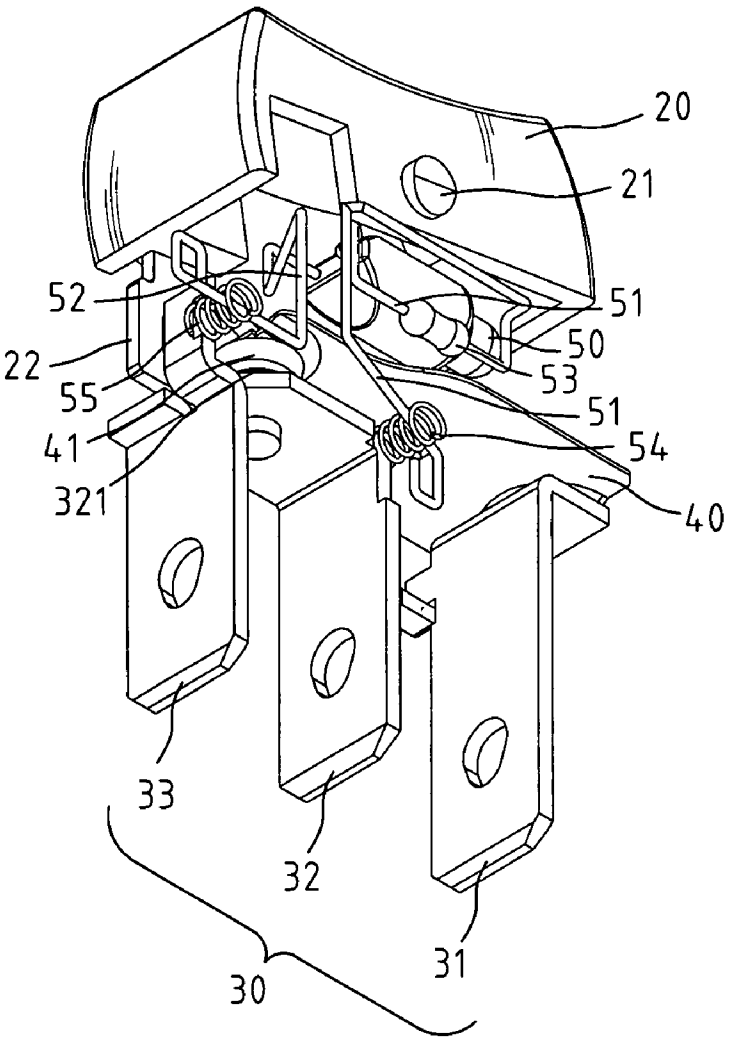
FIG. 8 is a schematic view showing part of the switch member according to the second embodiment of the present invention, wherein the case and the cover are removed for clarity purpose.

FIGS. 7 and 8 show a second embodiment of the present invention, wherein the first embodiment and the second embodiments have the same components and the differences between the two embodiments are assembling methods. When assembling the switch assembly according to the second embodiment, one end of the first resilient member 54 clamps the first leg 51 of the indicator 50 and one end of the second resilient member 55 clamps the second leg 52 of the indicator 50. Similar to the first embodiment, the indicator 50 is mounted on the board 13 1. The first leg 51 of the indicator 50 and the resistor 53 are connected to the inner side of the cover 13. The end of the first leg 51 is clamped in the clamp slot of the first clamp member 132 and one end of the first resilient member 54 sleeves on the first clamp member 132. The second leg 52 of the indicator 50 is connected to the inner side of the cover 13. The end of the second leg 52 is clamped in the clamp slot of the second clamp member 133 and the end of the second resilient member 55 sleeves on the second clamp member 133. The indicator 50, the first leg 51, the second leg 52, the first resilient members 54 and the second resilient members 55 are installed at inner side of the cover 13. Moreover, one end of the first resilient member 54 located away from the first clamp member 132 is inserted into the first recess 151 of the second slot 15 and one end of the second resilient member 55 located away from the second clamp member 133 is inserted into the second recess 161 of the third slot 16. Then, the cover 13 is assembled to the assembling opening 12 of the case 10 wherein the indicator 50 is located within the lower portion of the switch member 20.

As in the first embodiment and the second embodiment, the first resilient members 54 and the second resilient members 55 are respectively biased between the cover 13 and the case 10 so that the first resilient member 54 electrically connects the first leg 51 with the second terminal 32 and the second resilient member 55 electrically connects the second leg 52 with the third terminal 33. Therefore, the weak-current circuit of the indicator 50 is formed. Furthermore, the bias first resilient members 54 and the bias second resilient members 55 provide elastic forces to secure the connection.

The operation of the second embodiment is in the same way as in the first embodiment, as shown in FIGS. 5 and 6. In the second embodiment, the first resilient members 54 and the second resilient members 55 respectively firmly clamp the first leg 51 and the second leg 52 so as to more effectively avoid from loosening or bad connection between the contact points in the circuit.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A switch assembly having an indicator, comprising:

a hollow case having a top opening defined at a top thereof, an assembling opening defined at a side wall thereof and a cover corresponding to the assembling opening to assemble with the case and cover the assembling opening;

a hollow switch member received in the top opening of the case and pivotally connected with the case;

a plurality of terminals assembled to the case, the terminals comprising a first terminal, a second terminal and a third terminal;

a conductive member actuated by the switch member to open or close a circuit, the conductive member including a first end electrically connected with the first terminal and a second end being a free end corresponding to the second terminal; and an indicator having a first leg and a second leg, the first leg connected with a resistor;

wherein the indicator, the first leg and the second leg installed to an inner side of the cover; a first resilient member is bias between the first leg of the indicator and the second terminal to electrically connect the first leg and the second terminal; a second resilient member is bias between the second leg of the indicator and the third terminal to electrically connect the second leg and the third terminal; when the free end of the conductive member is separated from the second terminal, an open circuit is formed and the indicator does not work; when the free end of the conductive member is electrically connected with the second terminal, a closed circuit is formed and the indicator emits light.

2. The assembly as claimed in claim 1, wherein a board extends from the inner side of the cover and the indicator is disposed on the board.

3. The assembly as claimed in claim 1, wherein the first resilient member has a first end clamping the first leg of the indicator and a second end pressed against and electrically connected with the second terminal, the second resilient member has a first end clamping the second leg of the indicator and a second end pressed against and electrically connected with the third terminal.

4. The assembly as claimed in claim 1, wherein the first resilient member is a helical spring.

5. The assembly as claimed in claim 1, wherein the second resilient member is a helical spring.

6. The assembly as claimed in claim 1, wherein at least a portion of the switch member is made of a material that is pervious to light.

* * * * *